United States Patent [19]

Andrews et al.

[11] Patent Number: 4,655,049

[45] Date of Patent: Apr. 7, 1987

[54] PURE-AIR GENERATOR

[75] Inventors: David K. Andrews, Cheltenham; Trevor P. Benson, Evesham; Michael W. Smart, Churchdown, all of England

[73] Assignee: Dowty Fuel Systems Limited, Cheltenham, England

[21] Appl. No.: 767,428

[22] Filed: Aug. 20, 1985

[30] Foreign Application Priority Data

Sep. 5, 1984 [GB] United Kingdom ..... 8422444

[51] Int. Cl.[4] ..... F25B 19/02

[52] U.S. Cl. ..... 62/172; 62/401; 55/20; 55/163; 55/213; 55/217

[58] Field of Search ..... 55/20, 21, 163, 213, 55/217; 62/172, 401

[56] References Cited

U.S. PATENT DOCUMENTS

| | | | |
|---|---|---|---|
| 2,562,918 | 8/1951 | Hynes | 62/172 |
| 3,222,883 | 12/1965 | Glaspie | 62/172 |
| 4,078,390 | 3/1978 | Duvall | 55/20 X |
| 4,550,573 | 11/1985 | Rannenberg | 62/172 |
| 4,564,286 | 3/1985 | Carlisle et al. | 55/20 |

FOREIGN PATENT DOCUMENTS

| | | | |
|---|---|---|---|
| 3139683 | 4/1983 | Fed. Rep. of Germany | 55/163 |
| 0555262 | 7/1977 | U.S.S.R. | 62/401 |

*Primary Examiner*—Charles Hart

*Attorney, Agent, or Firm*—Hayes, Davis & Soloway

[57] ABSTRACT

A generator for producing pure air at high pressure includes a compressor, electrical means for driving the compressor and means for purifying compressed air generated by the compressor. A first sensor is provided for detecting the pressure of the compressed air and a second sensor for detecting the absolute temperature of that air. Means is provided for transferring an electrical signal from the first sensor to an electronic controller. Means is also provided for transferring an electrical signal from the second sensor to the controller. The controller processes these electrical signals and varies the power supplied to the means for driving the compressor in such a manner that the ratio of pressure of the compressed air to the absolute temperature of the compressed air remains substantially constant.

11 Claims, 2 Drawing Figures

PURE-AIR GENERATOR

This invention is concerned with a generator for producing pure air at high pressure.

In the generation of pure air at high-pressure it is known to drive a compressor by means of a variable-speed motor. The high pressure air derived from the compressor is passed through a coalescer and through charcoal cloth and molecular seive elements.

Any free water which has separated from the air during its compression is trapped in the coalescer. Impurities, such as hydrocarbons, carbon dioxide and water vapour, contained in the compressed air are absorbed by the sieve elements.

When the pure compressed air from such a generator is used in a closed system and is permitted to expand, e.g. for the purpose of cooling, the low-pressure air is fed back to the compressor, for recompression, by way of a return line.

Such return line is customarily provided with a pressure-relief valve and with a "snifting" valve. The former allows air to leave the return line if the pressure of the air rises above ambient atmospheric pressure. The latter permits air to enter the line if the pressure of the air in the return line drops below ambient atmospheric pressure.

Variations in pressure of the air in a closed circuit and variations in the ambient temperature result in changes in the mass of air contained in the closed circuit system; as a consequence air is expelled from the system or drawn into the system.

Such exchanges of air between a closed circuit system and the atmosphere can reduce the life of the charcoal cloth sieve element(s) and the molecular sieve elements.

According to this invention, a generator for producing pure air at high pressure includes a compressor, electrical means for driving the compressor, means for purifying compressed air generated by the compressor, a first sensor for detecting the pressure of the compressed air, a second sensor for detecting the absolute temperature of the compressed air, means for transferring an electrical signal from the first sensor to an electronic controller and means for transferring an electrical signal from the second sensor to the electronic controller, which controller processes the electrical signals and varies the power supplied to the means for driving the compressor in such a manner that the ratio of pressure of the compressed air to the absolute temperature of the compressed air remains substantially constant.

Further, according to this invention, a closed-circuit cooling system includes a generator of the kind set forth in the immediately-preceding paragraph.

Figure 1:
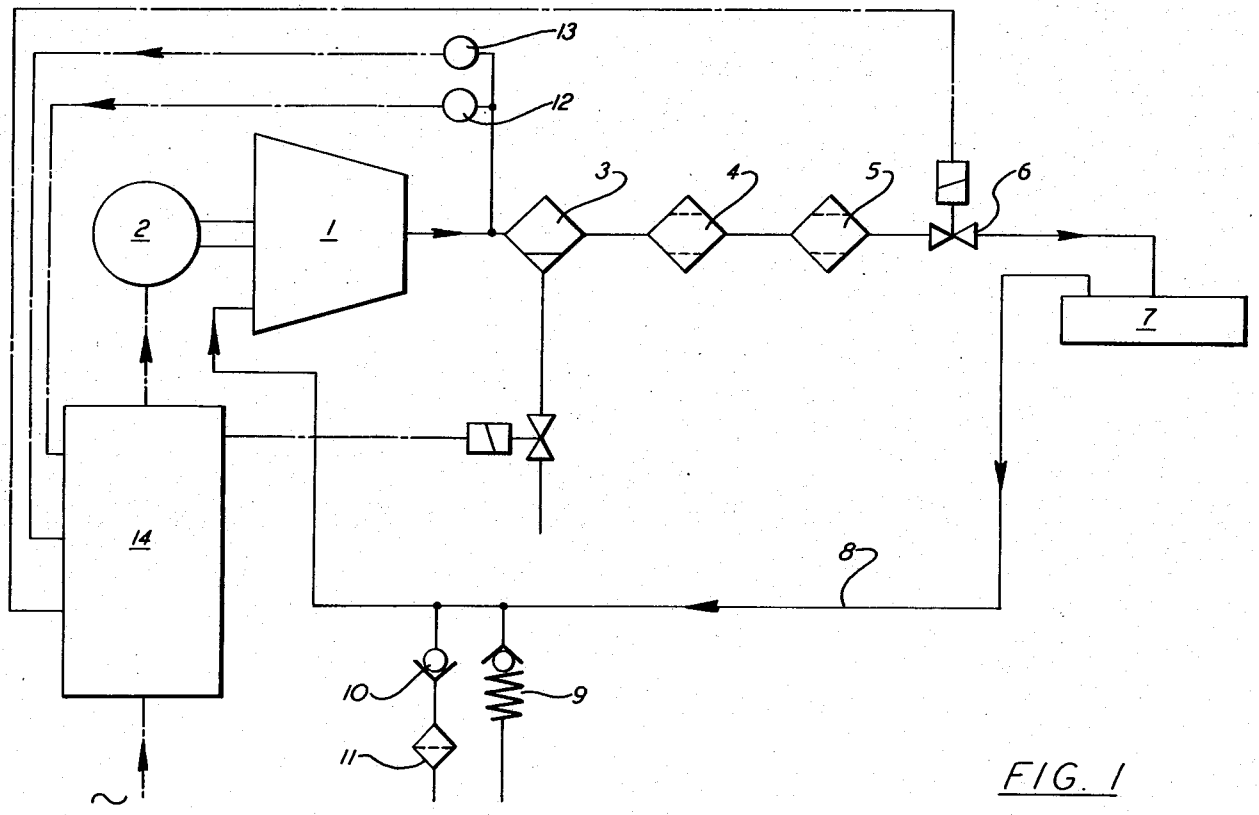
Figure 2:
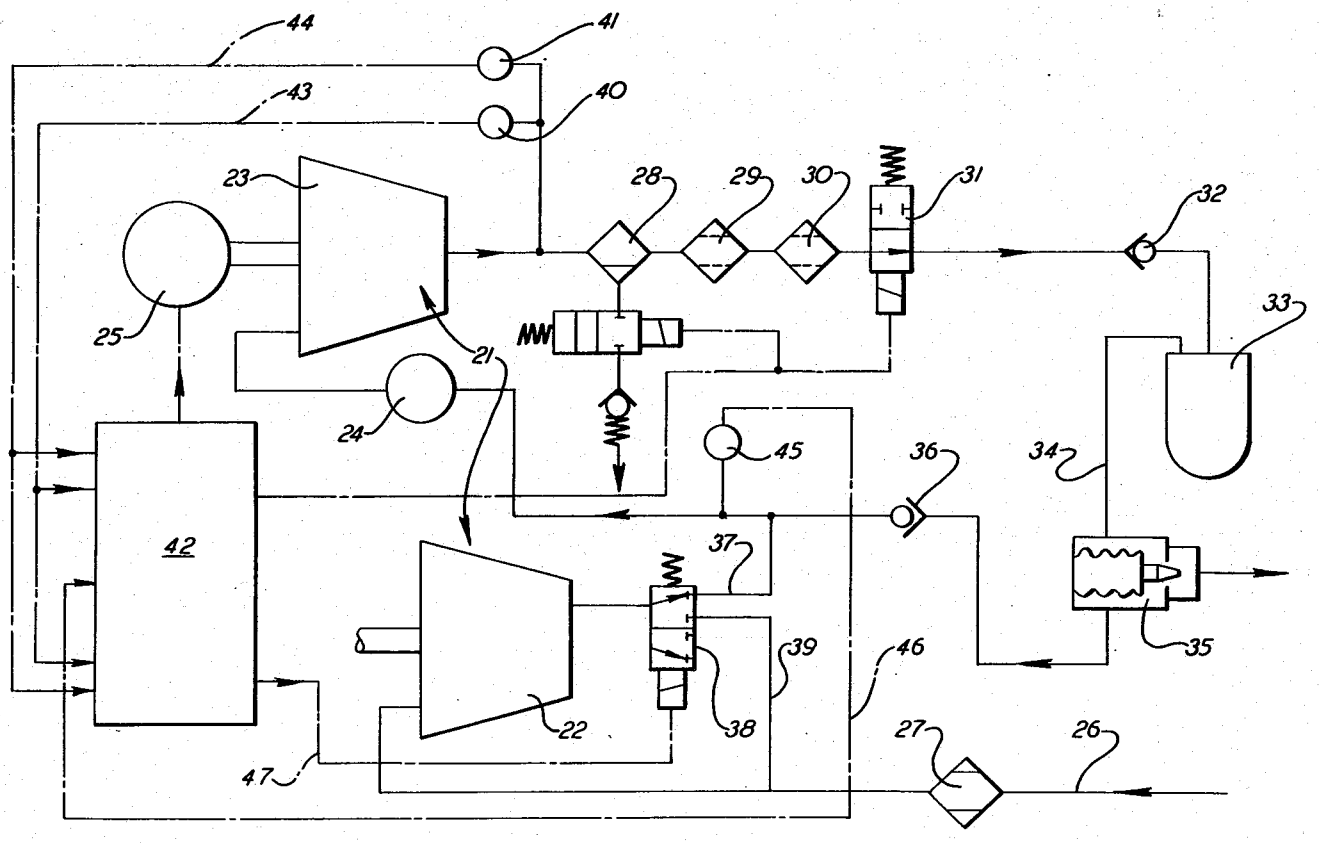

Two embodiments of the invention will now be described by way of example with reference to the accompanying drawings, of which:

FIG. 1 shows a schematic arrangement of a pure air generator in accordance with the first embodiment, and FIG. 2 shows a schematic arrangement of a pure air generator in accordance with the second embodiment.

Referring to FIG. 1, the compressor 1 is driven by an electric motor 2. Compressed air passes through an air-purification system comprising a coalescer 3, a charcoal cloth molecular sieve element 4 and zeolite molecular sieve element 5.

The purified compressed air is passed by way of a solenoid-operated valve 6 to a cooler 7 in which the air expands. Low-pressure air from the cooler is fed back to the compressor by way of a low-pressure line 8.

The low-pressure line 8 is connectible to the atmosphere surrounding the system firstly by a pressure-relief valve 9 and secondly by a snifting valve 10 and a particulate filter 11.

An electrical pressure sensor 12 and an electrical absolute temperature sensor 13 are associated with the compressed air delivered by the compressor. Electrical signals from the two sensors are fed to an electronic controller 14.

The electronic controller processes these signals in such a way that the power fed to the electric motor can be varied so as to maintain substantially constant the ratio of the pressure of the compressed air to the absolute temperature of the compressed air.

Since the mass of the air is, for a constant volume of the high-pressure part of the closed circuit system, proportional to the afore-mentioned ratio, the said variation in the speed of the electric motor will be such as to maintain substantially constant the mass of air in the high-pressure part.

This will lead to an increased life of the air purifying sieves.

With reference now to FIG. 2, in the second embodiment of the invention the compressor 21 comprises a first stage section 22 and a second, third and fourth stage section 23 having an interstage capacity indicated at 24 between those sections. The sections of the compressor are suitably driven by an electric motor 25. Air from the atmosphere enters the first stage section 22 of the compressor through an inlet line 26 which incorporates a charcoal cloth intake filter 27. Compressed air delivered by the fourth stage of the compressor passes through an air purification section comprising a coalescer 28, a charcoal cloth molecular sieve element 29 and a zeolite molecular sieve element 30.

The purified compressed air is passed by way of a solenoid-operated valve 31 and non-return valve 32 to a cooler 33 in which the air expands. Low-pressure air from the cooler is fed back to the second stage of the compressor by way of a low-pressure line 34 which incorporates an absolute pressure relief valve 35 capable of discharging to atmosphere and disposed just downstream of the cooler. A non-return valve 36 is also provided in line 34 beyond valve 35.

The first stage section 22 of the compressor is connected to line 34 at a point downstream of valve 36 by way of a line 37 which incorporates a solenoid-operated by-pass valve 38. When valve 38 closes line 37 delivery of air from the first stage section 22 is by-passed through line 39 into line 26 at a point downstream of intake filter 27.

An electrical pressure sensor 40 and an electrical absolute temperature sensor 41 are associated with the compressed air delivered by the compressor. Electrical signals from the two sensors are, as with those sensors of the first embodiment, fed to an electronic controller 42 through conductors 43, 44.

A further pressure sensor 45 senses the pressure of the air delivered by the first stage compressor section 22 into line 34 and electrical signals from that sensor are fed into controller 42 through conductor 46.

A conductor 47 is taken from the output side of controller 42 to the solenoid-operated by-pass valve 38.

The electronic controller processes the signals it receives through conductors 43, 44, 46 in such a way that the power fed to the electric motor can be varied so as to maintain substantially constant the ratio of the pressure of the compressed air to the absolute temperature of the compressed air. Thus since the mass of the air is, for a constant volume of the high-pressure part of the system, proportional to the afore-mentioned ratio, the said variation in the speed of the electric motor will be such as to maintain substantially constant the mass of air in the high-pressure part. As with the first embodiment this will lead to an increased life of the air purifying sieves.

Also, since the mass of air in the high-pressure part of the system is maintained substantially constant with variation in temperature the need to vent pure air to ambient, and take contaminated air into the system, during steady state operation is minimized.

The signals from sensor 45 are compared in the controller 42 with a datum value and resultant error signals used to control the by-pass valve 38 to bring the section 22 of the compressor into and out of circuit with section 23 of the compressor. The datum value for the interstage pressure will be set below the cracking pressure of the absolute pressure relief valve 35 which limits maximum cooler outlet pressure. If the interstage pressure exceeds the datum value the by-pass valve will be operated to close off flow into line 34 thereby by-passing the first stage delivery through line 39 back into line 26. If the interstage pressure falls below the datum value due to leakage flows, the by-pass valve will be operated to permit delivery from the first stage delivery into line 34 to restore the interstage pressure to a required nominal value, in this embodiment one bar.

As the compressor first stage is concerned only with handling leakage flows, which are significantly lower than the steady state cooler flow, it will be capable of maintaining the required interstage pressure of one bar at ambient pressure significantly lower than the minimum at which it would handle the maximum temperature steady state flow.

We claim:

1. A generator for producing pure air at high pressure including a compressor, electrical means for driving the compressor, means for purifying compressed air generated by the compressor, a first sensor for detecting the pressure of the compressed air, a second sensor for detecting the absolute temperature of the compressed air, means for transferring an electrical signal from the first sensor to an electronic controller and means for transferring an electrical signal from the second sensor to the electronic controller, which controller processes the electrical signals and varies the power supplied to the means for driving the compressor in such a manner that the ratio of pressure of the compressed air to the absolute temperature of the compressed air remains substantially constant, thereby to maintain the mass of the compressed air, before expansion, substantially constant.

2. A generator as claimed in claim 1, wherein said means for purifying said compressed air includes a coalescer and at least one sieve element in series with said coalescer.

3. A generator as claimed in claim 2, wherein two of said sieve elements are provided in series one with respect to the other.

4. A generator as claimed in claim 3, wherein said sieve elements comprise a charcoal cloth molecular sieve element and a zeolite molecular sieve element.

5. A generator as claimed in claim 1, wherein said compressor comprises two sections, and a third sensor is provided for detecting the interstage pressure between said sections, means being also provided for transferring electrical signals from said third sensor to said electronic controller.

6. A generator as claimed in claim 5, wherein a by-pass valve is provided in association with one of said sections of said compressor and is so adapted that under signals derived from said electronic controller it is capable of connecting and disconnecting the delivery side of said one section with respect to a circuit containing the other of said sections of said compressor.

7. A generator as claimed in claim 2, wherein said compressor, said coalescer and said sieve element or elements are contained in a closed circuit, and a low-pressure line of that circuit is connectible to atmosphere by a pressure relief valve and by a snifting valve.

8. A generator as claimed in claim 6, wherein a low-pressure line which forms part of said circuit incorporates an absolute pressure relief valve.

9. A generator as claimed in claim 1, wherein said electronic controller includes means for comparing the electrical input signals transmitted thereto each with a datum signal value and the resultant error signals are transmitted by the controller for appropriate control of said means for driving the compressor.

10. A generator as claimed in claim 6, wherein said electronic controller includes means for comparing the electrical signals transmitted thereto each with a datum signal value and the resultant error signals are transmitted by the controller for appropriate control of said by-pass valve and said means for driving said compressor.

11. A closed-circuit cooling system including a generator as claimed in claim 1.

* * * * *